US005697299A

United States Patent [19]

Umetani et al.

[11] Patent Number: 5,697,299

[45] Date of Patent: Dec. 16, 1997

[54] INK SUPPLYING AND COLLECTING DEVICE FOR USE IN PRINTING PRESSES

[75] Inventors: Yoichi Umetani, Sakai; Ichiro Murakawa, Izumi, both of Japan

[73] Assignee: Umetani Mfg. Co., Ltd., Osaka, Japan

[21] Appl. No.: 794,967

[22] Filed: Feb. 5, 1997

[30] Foreign Application Priority Data

| | | | |
|---|---|---|---|
| Feb. 9, 1996 | [JP] | Japan | HEI 8-24494 |
| Feb. 28, 1996 | [JP] | Japan | HEI 8-41901 |
| Mar. 15, 1996 | [JP] | Japan | HEI 8-1798 U |
| Mar. 15, 1996 | [JP] | Japan | HEI 8-1800 U |

[51] Int. Cl.[6] ..... B41F 31/06; B41F 31/08

[52] U.S. Cl. ..... 101/366

[58] Field of Search ..... 101/366, 350, 101/363, 364, 148, 207–210, 425; 118/258, 259; 222/576, 578, 580, 581, 583, 321.1, 321.7, 325, 373, 399

[56] References Cited

U.S. PATENT DOCUMENTS

| | | | |
|---|---|---|---|
| 4,099,461 | 7/1978 | Mitter | 101/119 |
| 4,787,313 | 11/1988 | Osborn | 101/366 |
| 5,265,535 | 11/1993 | Isowa et al. | 101/350 |

FOREIGN PATENT DOCUMENTS

| | | |
|---|---|---|
| 56-139964 | 10/1981 | Japan . |
| 04310743 | 11/1992 | Japan . |
| 07314650 | 12/1995 | Japan . |

*Primary Examiner*—J. Reed Fisher

*Attorney, Agent, or Firm*—Arnold B. Silverman; Eckert Seamans Cherin & Mellott, LLC

[57] ABSTRACT

An ink supplying and collecting device for an ink reservoir formed between a main roll for applying an ink to a plate cylinder and an auxiliary roll in contact with the main roll, the device being adapted to supply the ink to the ink reservoir by causing the ink to flow out from a nozzle extending downward as directed toward the ink reservoir while moving the nozzle in parallel to axia direction of the rolls, and to collect the ink by lowering the nozzle to a position close to the bottom of the ink reservoir and drawing up the ink with the nozzle while moving the nozzle in parallel to the axial direction of the rolls. The device comprises a closed pressure container movableby a drive unit in parallel to the rolls for removably accommodating an ink tank therein, a nozzle unit hermetically inserted in the container and having one end loosely extending through an opening of the ink tank to a position close to the bottom of the tank and the other end providing the nozzle, and a pressurizing unit and a pressure reducing unit switchably connected to the container. When supplying the ink, the internal pressure of the container and the tank is increased by the pressurizing unit to a level higher than atmospheric pressure to cause the ink in the tank to flow out from the nozzle. When collecting the ink, the pressure reducing unit gives a negative internal pressure to the container and the tank, causing the nozzle to draw up the ink from the reservoir and collect the ink into the tank.

6 Claims, 12 Drawing Sheets

INK SUPPLYING AND COLLECTING DEVICE FOR USE IN PRINTING PRESSES

FIELD OF THE INVENTION

The present invention relates to an ink supplying and collecting device mainly for use in printing presses for corrugated board sheets.

BACKGROUND OF THE INVENTION

The printing presses recently in use for corrugated board sheets include a printing press adapted for use with an ink of the type intermediate between the quick drying ink (flexographic ink) for use in flexographic presses, and the slow drying ink for longitudinal feeding rotary presses (U.S. Pat. No. 5,265,535).

With reference to FIG. 10, the printing press wherein the ink of intermediate type is used comprises a plate cylinder 12 provided with a machine plate around the surface thereof, a main roll 1 in contact with the plate cylinder 12 and formed with fine indentations or projections over the surface thereof, an auxiliary roll 11 opposed to the main roll 1 in contact therewith, and a device 100 for supplying and collecting the ink.

The ink has a slightly higher viscosity than the flexographic ink and the characteristics of being slow drying when applied to the roll and quick drying when applied to a corrugated board sheet S. The ink dries in about 10 seconds on the sheet.

The ink is supplied to an ink reservoir between the rolls, collects in the minute indentations in the surface of the main roll 1 and is transferred onto the plate cylinder 12. With an excess of ink removed by the auxiliary roll 11, the surface portion of the main roll 1 moving past the auxiliary roll 11 has formed thereon a layer of ink which is uniform over the entire length of the roll 1. Consequently, the ink adheres uniformly to the raised areas of the machine plate on the plate cylinder 12 to which the ink is delivered from the main roll 1, and the printing operation can be effected free of problems such as ink spots, color irregularities or ghost.

The ink used has a slightly higher viscosity than the conventional flexographic ink and therefore produces glossy beautiful prints.

Like the flexographic press, the press does not require circulation of the ink through a recycling channel for preventing solidification of the ink, permitting use of a simplified device for supplying and collecting the ink. For example, the ink can be supplied and collected by the same device 100 using a tube pump 101 shown in FIG. 11.

The ink supplying-collecting device 100 has a support table 9 disposed above the rolls 1, 11 and slidable in parallel to the axes of the rolls. The support table 9 is coupled to a slide drive device 95.

Provided on the support table 9 are the tube pump 101, a nozzle support 72 connected to an air cylinder 71 for upward and downward movement, a nozzle 64 mounted on the support 72 and bent downward to position the nozzle lower end as opposed to the ink reservoir between the rolls 1, 11, an ink tank 3 and a flexible tube 103 connecting the ink tank 3 to the nozzle 64 via the tube pump 101.

The construction of the tube pump 101 is known as shown in FIGS. 10 and 12. The pump has the tube which is pressed by a rotor **101*b* for transporting the ink. The direction of transport can be changed by changing the direction of rotation of a motor 102**.

The ink is supplied to the ink reservoir between the rolls 1, 11 by forwardly rotating the rotor **101*b* of the tube pump 101 while moving the support table 9 in parallel to the rolls 1, 11**.

The ink is collected from the ink reservoir between the rolls 1, 11 into the ink tank 3 by causing the air cylinder 71 to lower the nozzle support 72 to bring the lower end of the nozzle 64 close to the bottom of the reservoir and reversely rotating the rotor **101*b* of the tube pump 101 while slidingly moving the support table 9** in parallel to the rolls in this state.

When the ink is to be changed, the flexible tube 103 is removed from the tube pump 101, and the set of ink tank 3, flexible tube 103 and nozzle 64 is replaced by another set. The rolls 1, 11 are cleaned by a cleaner 10.

With reference to FIG. 10, the cleaner 10 for the rolls 1, 11 is disposed above the main roll 1 and comprises a rubber roll 13, a steel roll 14 in contact with the roll 13, a scraper 15 in bearing contact with the steel roll 14, and a shower nozzle 17 in the form of a horizontally elongated pipe and disposed above the steel roll 14.

Water is caused to flow down in drops from the shower nozzle 17, with the main roll 1 raised into contact with the rubber roll 13.

The ink adhering to the main roll 1 is transferred to the steel roll 14 by the rubber roll 13, then scraped off by the scraper 15 and collects in a receptacle 16.

Also practiced is a method where a scraper 18 indicated in a broken line and pressed against the auxiliary roll 11 is used for cleaning in place of the cleaner 10.

Needless to say, the smaller the amount of ink in the reservoir between the rolls, the shorter can be the time required for cleaning the rolls.

The ink supplying-collecting device of the tube pump type requires labor for setting the flexible tube 103 in the tube pump 101. The flexible tube 103 is set in the tube pump 101 by removing an upper lid **101*a* from the pump 101 and fitting the tube 103 in a bent form around the rotor 101*b*, whereas this procedure must be performed by the operator while he is upwardly viewing the tube pump 101** from below since the pump is installed at a level of about 1.7 m because of the structure of the printing press, hence a low work efficiency.

The flexible tube 103 is adapted to be pressed by the rotor **101*b*** and therefore made of a soft material.

When the nozzle support 72 is lowered for collecting the ink as seen in FIG. 12, the flexible tube 103 bends to a V-form as indicated at **103*a* between the tube pump 101 and the base end 64*b* of the nozzle 64 to hinder flow of the ink and exhibit a greatly impaired drawing capacity. Consequently collection of the ink requires repeated reciprocation of the nozzle 64 in the axial direction of the rollers and a prolonged period of time. If becoming completely bent at 103*b***, the tube is almost unable to draw any ink.

The flexible tube 103 also often becomes bent to a V-form when the tube 103 is set in position around the rotor **101*b*, so that the tube 103** needs to be set carefully.

The tube pump further has the characteristics that presence of air inside the flexible tube 103 impairs its transport capacity. Even if the nozzle lower end is moved down to the bottom of the ink reservoir between the rolls, air invariably flows into the tube through the nozzle end upon a reduction in the amount of ink, inevitably decreasing the capacity of the tube pump 101.

Further because the tube extends at least around the rotor **101*b*, the use of the tube pump 101** makes the tube inevitably longer by an amount corresponding to the bend, consequently permitting an increased amount of ink to be wasted as deposited inside the tube and necessitating increased labor for cleaning the tube.

The increase in the length of the tube results in an increased rise time, i.e., an increased period of time required for the ink to be actually supplied to the reservoir between the rolls or for the tube to start to draw the ink for collection after the tube pump 101 is initiated into operation, hence a low efficiency.

The conventional nozzle has a slanting elliptical opening formed by obliquely cutting its lower end as shown in FIG. 10. Accordingly, even when the nozzle lower end is lowered to the bottom of the ink reservoir between the rolls, air inevitably ingresses into the nozzle through the upper portion of its elliptical end opening if the quantity of ink decreases to impair the capacity of the tube pump 101. When the liquid level of the ink lowers to the lower portion of the elliptical opening, the nozzle becomes almost unable to collect the ink.

The quantity of ink remaining uncollected in the reservoir is therefore not small, is wasted and subsequently requires a longer period of time for cleaning the rolls.

SUMMARY OF THE INVENTION

An object of the present invention is to overcome the foregoing problems heretofore encountered and to provide an ink supplying and collecting device permitting a facilitated change of ink with minimized waste of ink.

The present invention provides an ink supplying and collecting device for supplying an ink to an ink reservoir by causing the ink to flow out from a nozzle 64 while moving the nozzle 64 in parallel to rolls 1, 11, and collecting the ink by lowering the nozzle 64 to a position close to a bottom of the ink reservoir and drawing up the ink with the nozzle 64 while moving the nozzle 64 in parallel to the axial direction of the rolls, the device comprising a closed pressure container 2 disposed above the rolls 1, 11 and movable by a drive unit 95 in parallel to the rolls for removably accommodating an ink tank 3 therein, the ink tank 3 replaceably accommodated in the pressure container 2, a nozzle unit 6 hermetically inserted in the pressure container 2 and having one end extending into the ink tank 3 to a bottom of the ink tank 3 and the other end providing the nozzle 64, and a pressurizing unit 4 and a pressure reducing unit 5 switchably connected to the pressure container 2.

When supplying the ink, the interior of the pressure container 2 and the interior of the ink tank 3 are pressurized to a level higher than atmospheric pressure by the pressurizing unit 4 to cause the ink to flow out from the ink tank 3 through the nozzle 64 and supply the ink to the ink reservoir between the rolls.

When collecting the ink, the interior of the pressure container 2 and the interior of the ink tank 3 are given a negative pressure by the pressure reducing unit 5 to cause the nozzle 64 to draw the ink therethrough from the reservoir into the ink tank 3.

Since the internal pressure of the pressure container 2 and the ink tank 3 is increased or decreased to supply or collect the ink, the ink can be supplied or collected within a shorter period of time than when the conventional tube pump 101 is used, by reducing the ink supply or collection rise time and increasing the amount of transport of the ink per unit time.

When a flexible hose 62 is used to provide a channel 60 between the ink tank 3 and the nozzle 64, the hose can be of such a hard material that it will not be bent to a V-form by upward and downward movement of the nozzle 64 unlike the tube pump which, if used, bends the tube to a V-form to greatly impair the transport capacity of the pump.

The increased pressure or the suction force to be applied to the closed pressure container 2 is controllable to adjust the ink supplying or collecting capacity as desired.

DETAILED DESCRIPTION OF EMBODIMENT

Figure 1:
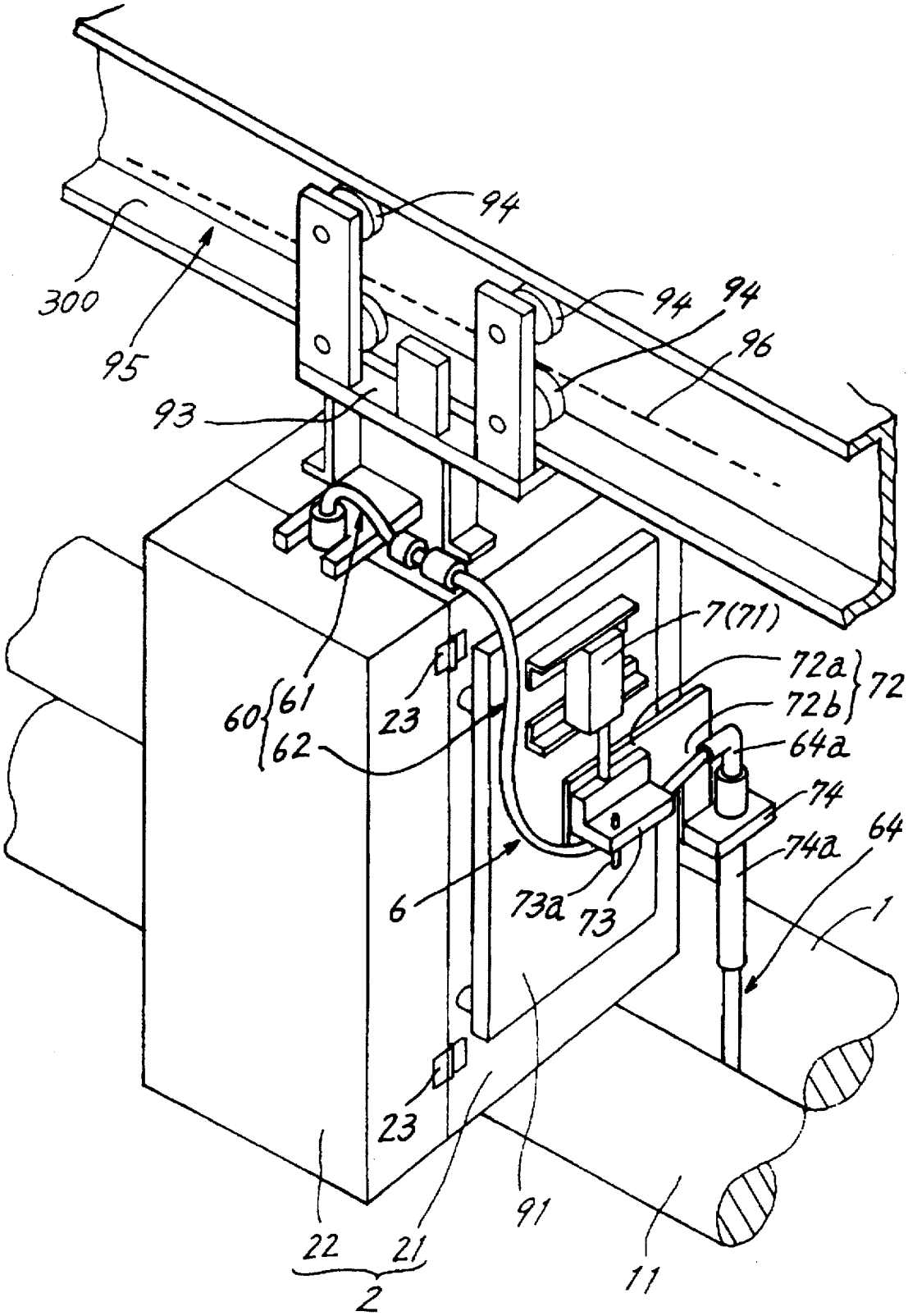
FIG. 1 is a perspective view of an ink supplying and collecting device for use in corrugated board printing presses.
Figure 10:
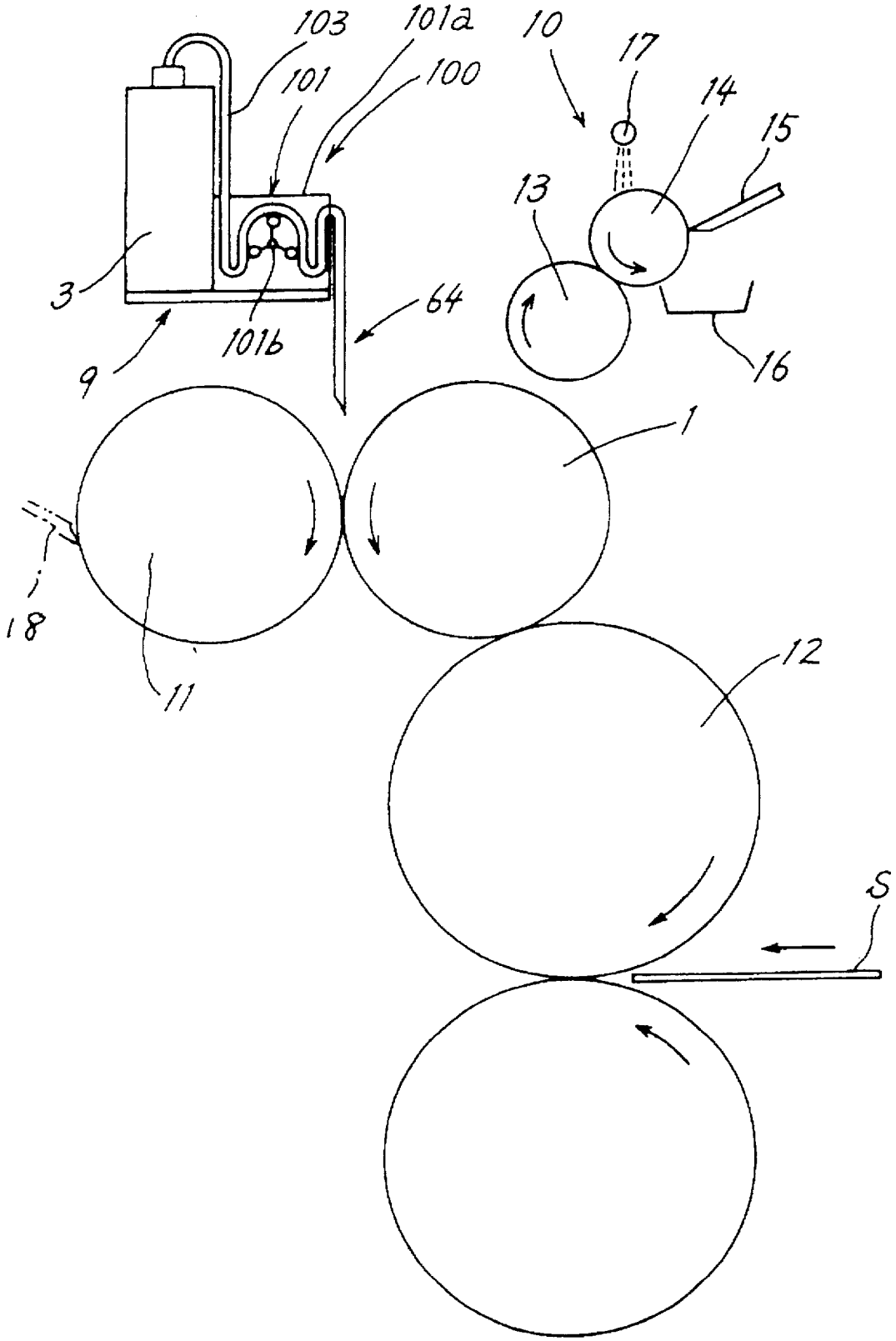
FIG.10 PRIOR ART
FIG. 10 is a front view of a conventional printing press wherein an ink of the intermediate type is used.
Figure 11:
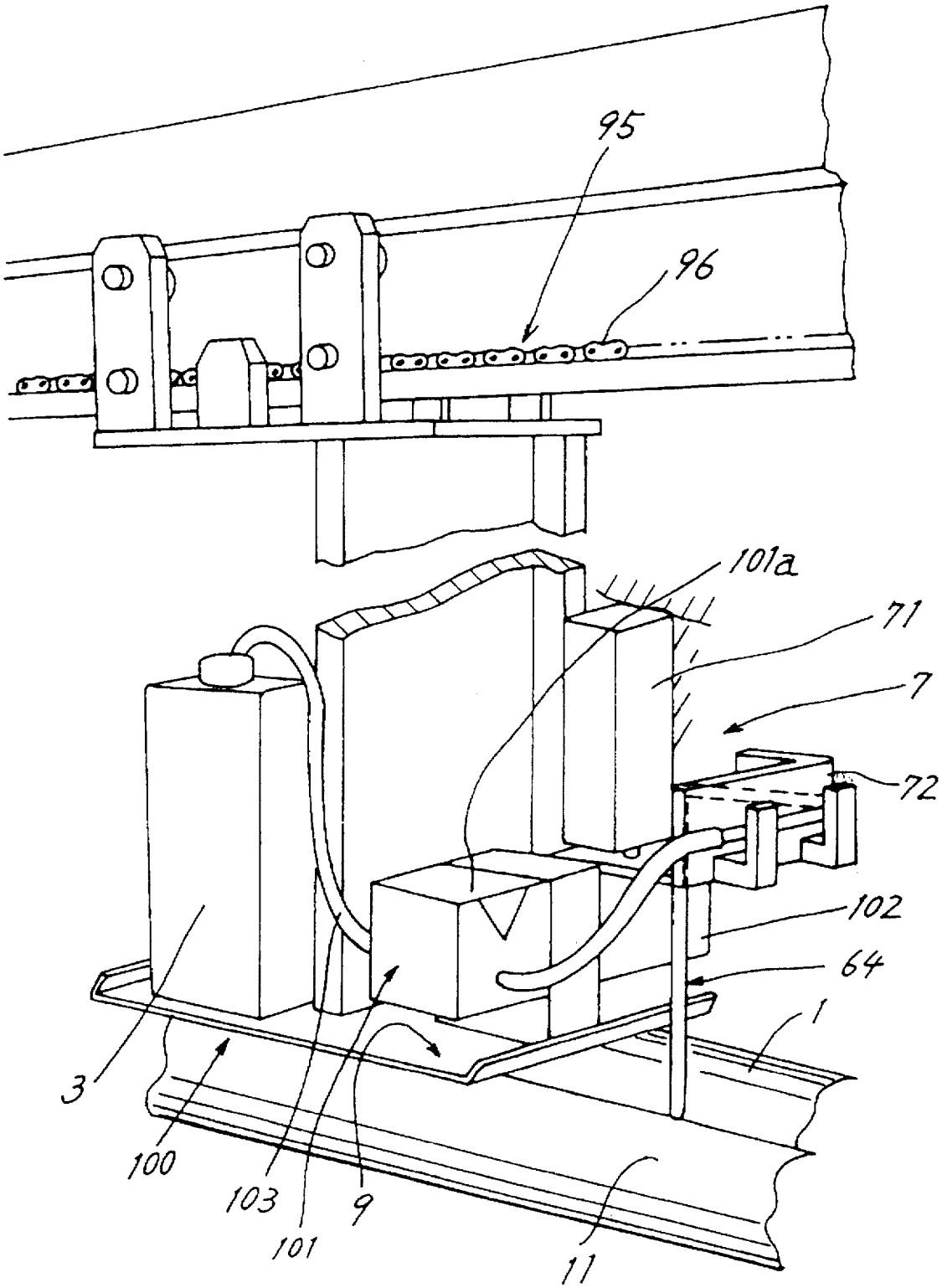
FIG. 11 PRIOR ART
FIG. 11 is a perspective view of a conventional ink supplying-collecting device comprising a tube pump.
Figure 12:
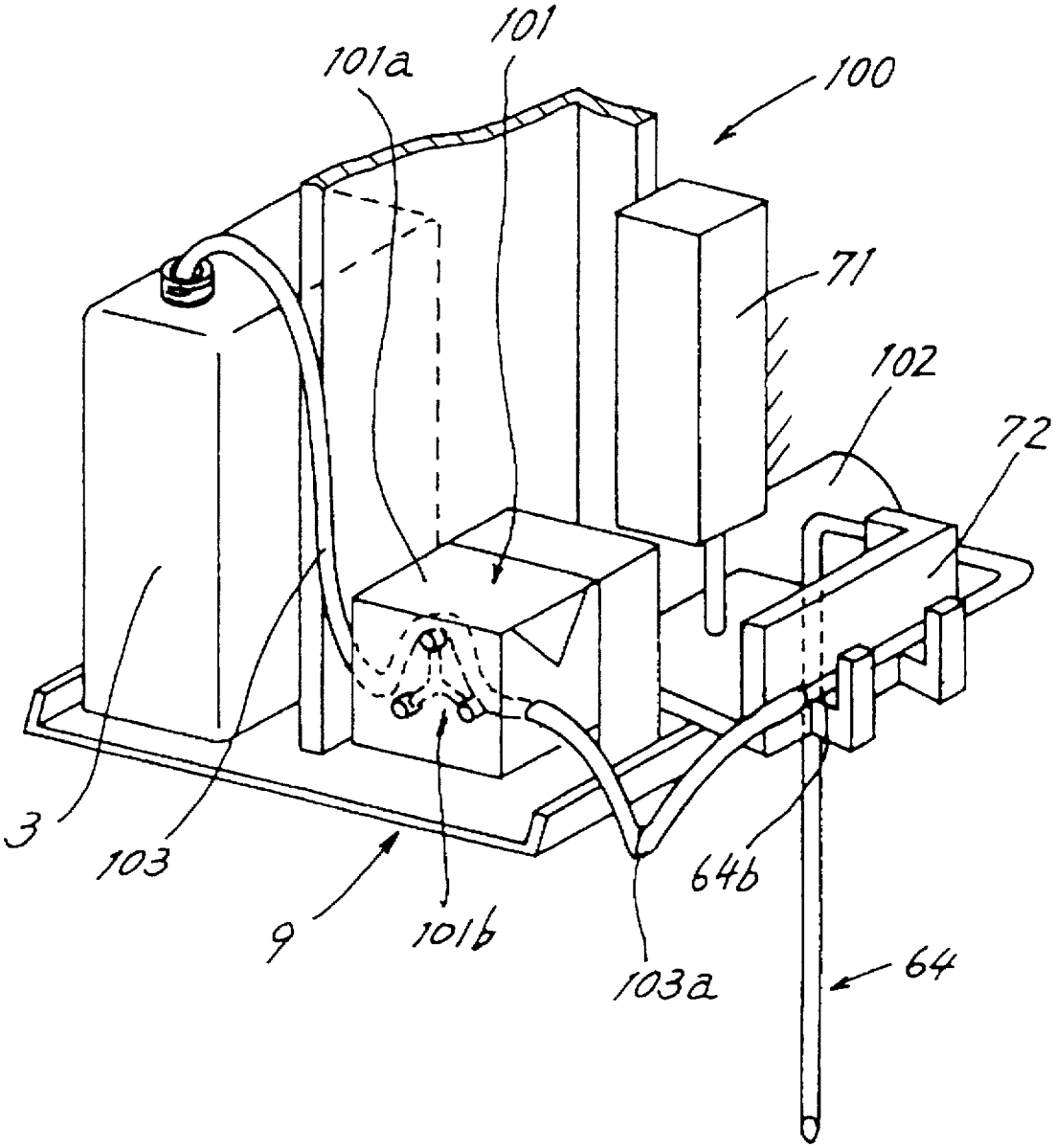
FIG. 12 PRIOR ART
FIG. 12 is a perspective view showing the tube of the tube pump as bent to a V-form.

With reference to FIG. 1, a base plate 93 is disposed above a main roll 1 and an auxiliary roll 11 and is slidable in parallel to the axial direction of the rolls. As in the case of the conventional press shown in FIG. 10, the main roll 1 is movable into and out of contact with a plate cylinder 12 and formed with fine indentations or projections over the surface thereof. The auxiliary roll 11 has a surface layer of rubber and is movable into and out of contact with the main roll 1 in opposed relation therewith.

The base plate 93 carries a plurality of guide rollers 94 rollably in engagement with a guide frame 300 and is connected to an endless chain 96 provided along the guide frame 300. The chain 96 is coupled to a drive sprocket (not shown) to provide a drive unit 95 for the base plate 93.

A closed pressure container 2 for accommodating an ink tank 3 is supported by the base plate 93 in suspension.

Figure 2:
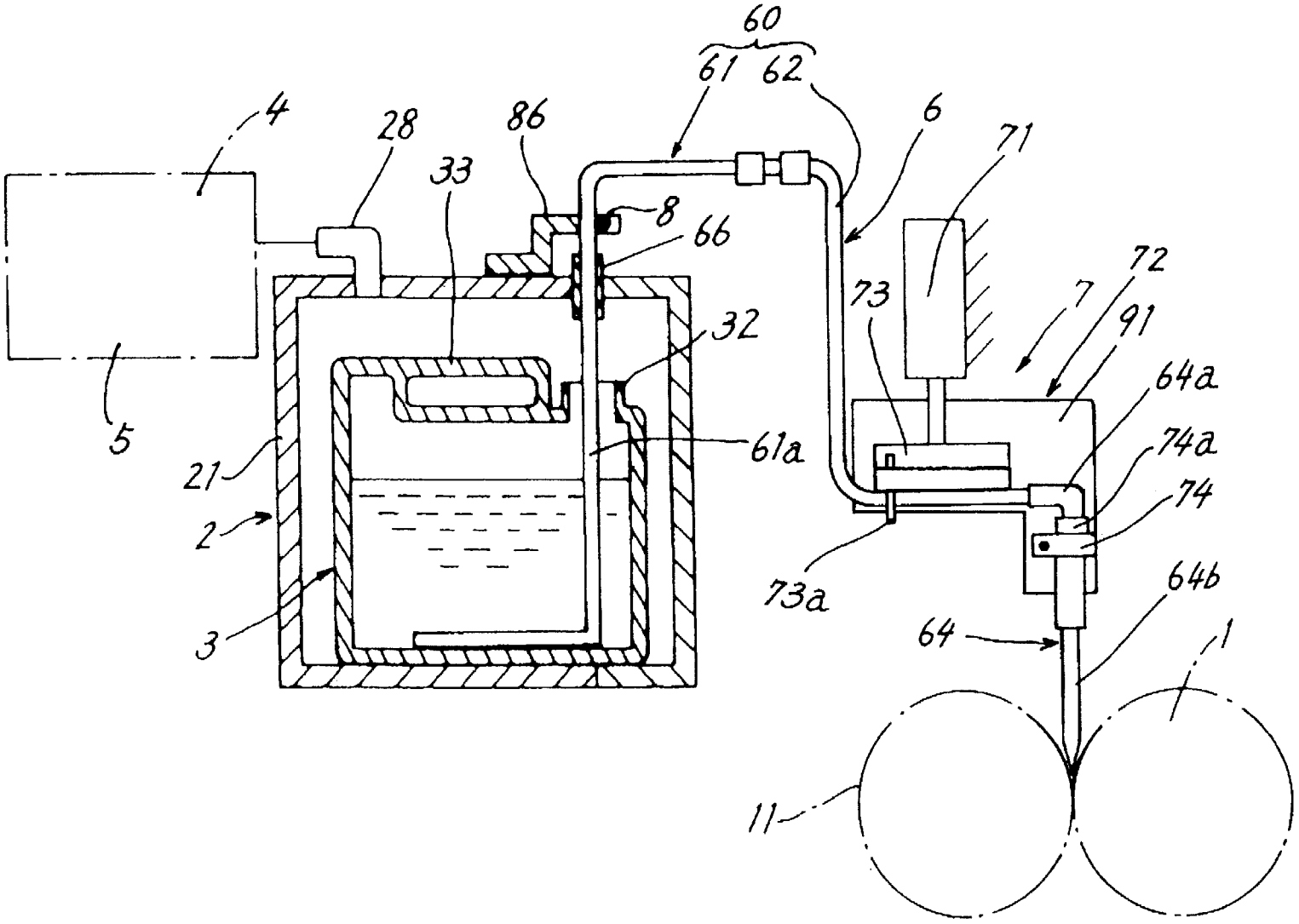
FIG. 2 is a front view partly in section and showing the same.

Although FIG. 2 shows the pressure container 2 as having such a size as to provide a large clearance around the ink tank 3 for a better understanding, it is actually desired that the container 2 have a minimized size permitting the ink tank 3 to be placed into and removed from the container so as to shorten the time required to increase or decrease the internal pressure of the container 2.

Figure 3:
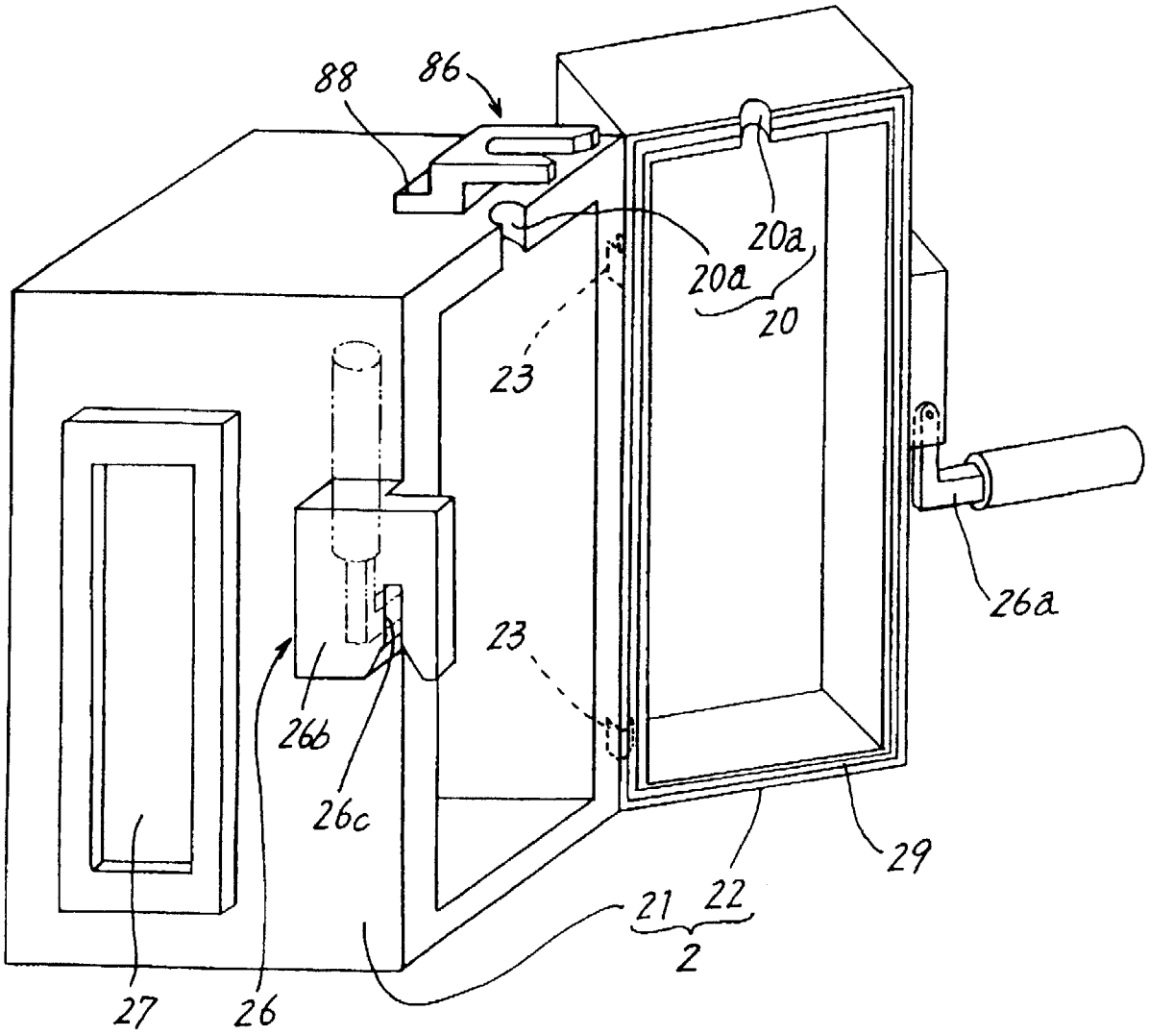
FIG. 3 is a perspective view of a closed pressure container.

As shown in FIG. 3, the pressure container 2 comprises two divided segments, i.e., a container main body 21 having an open side, and a closure 22 attached to the main body for closing the open side.

A seal member 29 is attached to one or both of the opposed abutting faces of the container main body 21 and the closure 22.

The closure 22 is openably attached to the main body 21 by hinges 23 and held in a closed state to the main body 21 by latch means 26.

An example of latch means 26 will be described with reference to FIG. 3.

The latch means 26 comprises an L-shaped lever 26a supported at its one end on the free end of the closure 22 and pivotally movable in a vertical plane, and a receiving member 26b provided on the main body 21.

The receiving member 26b has a fitting groove 26c having an open lower end.

When the L-shaped lever 26a is rotated upward with the closure 22 closed, the base end of the lever 26a fits into the groove 26c of the receiving member 26b, hermetically sealing the boundary between the main body 21 and the closure 22 with the seal member 29 pressed therebetween.

The container main body 21 and the closure 22 are each formed with a semicircular cutout 20a. When the main body 21 is closed with the closure 22, the cutouts 20a, 20a form a circular bore 20 across the boundary between the main body 21 and the closure 22.

A pipe 61 of the nozzle unit 6 to be described below is passed through the bore 20.

A transparent inspection window 27 hermetically covered with a transparent plate is formed in a side wall of the main body 21. The amount of ink remaining in the ink tank 3 within the closed pressure container 2 can be recognized visually through the inspection window 27.

Provided on the top wall of the main body 21 is a conduit support 86 positioned in corresponding relation with the semicircular cutout 20a.

Figure 4A:
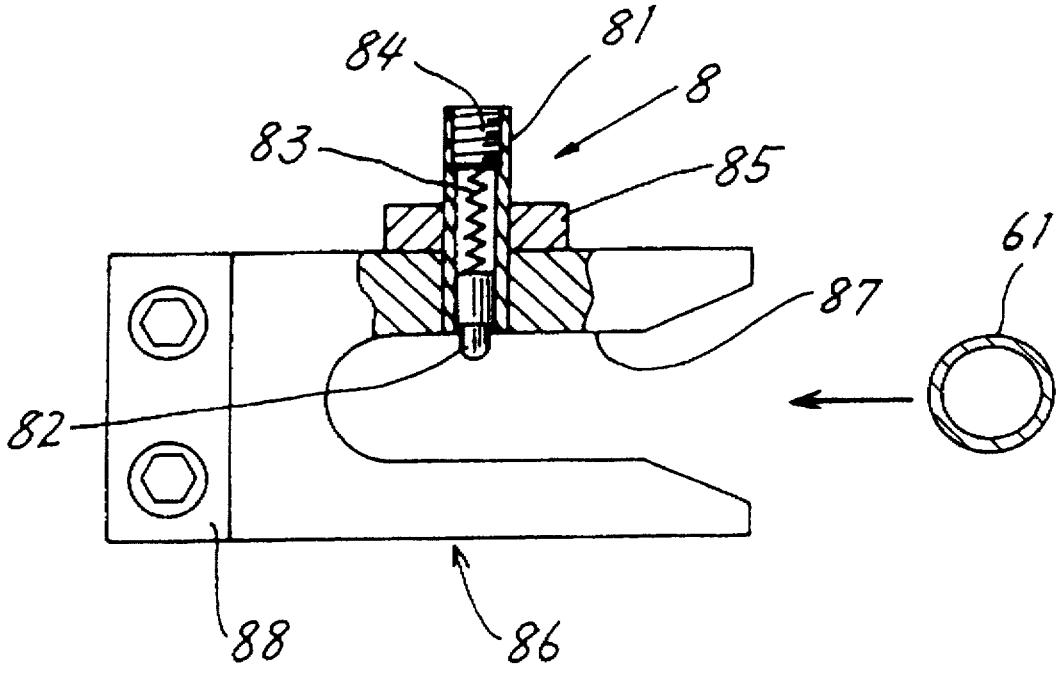
FIGS. 4A and 4B are plan views showing a support partly in section, FIG. 4A showing the support with no pipe fitted thereto, FIG. 4B showing the support with a pipe fitted thereto.
Figure 4B:
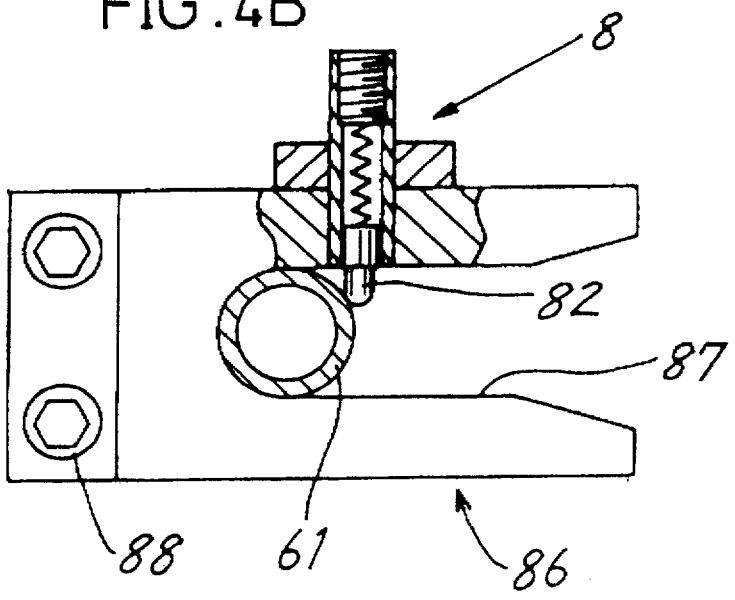
Figure 5:
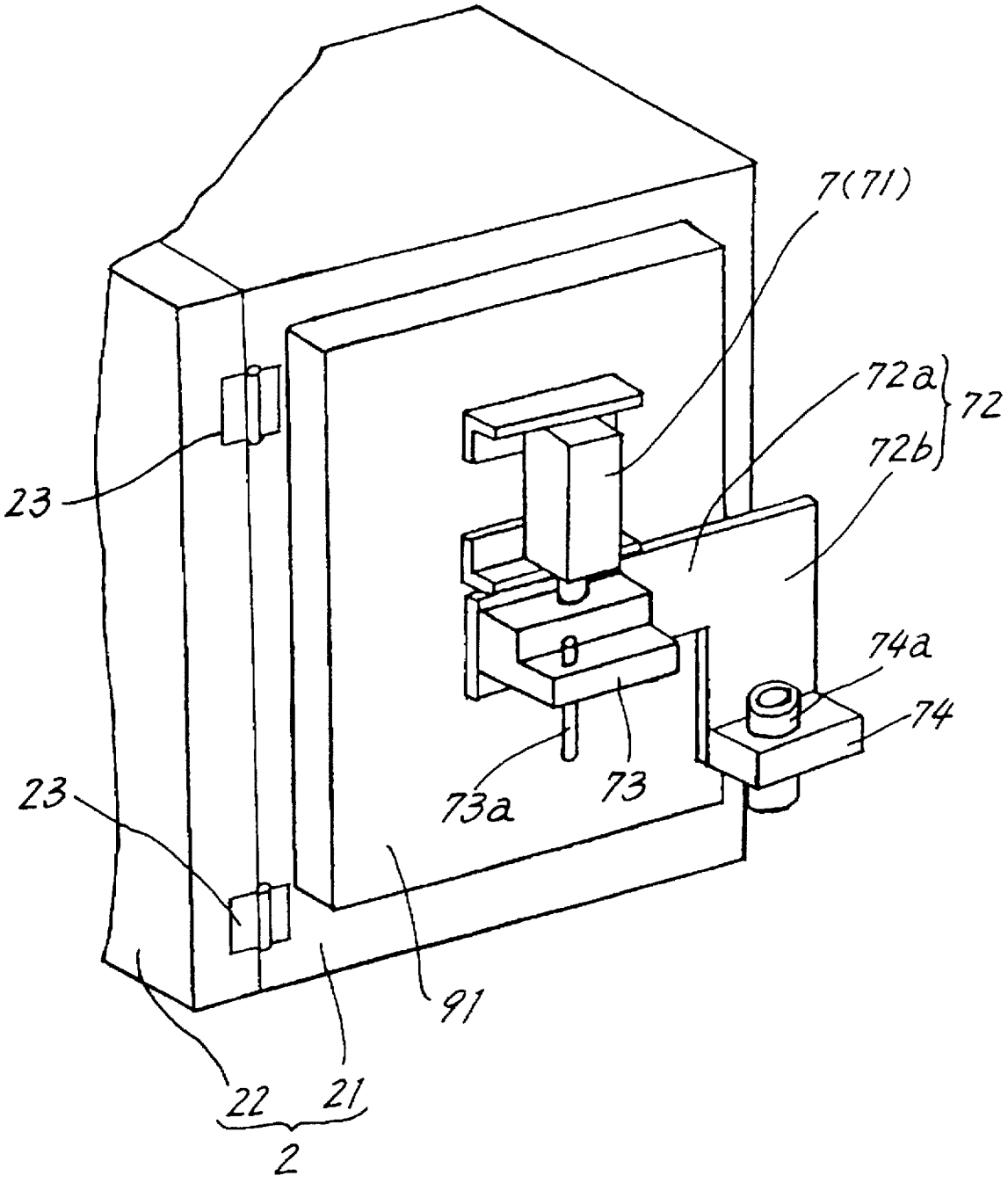
FIG. 5 is a perspective view of a nozzle support with a nozzle unit removed therefrom.

The support 86 has a short downward leg 88 at a base end thereof and a U-shaped cutout 87 in an outer end thereof as shown in FIGS. 4A and 4B. The cutout 87 has a width slightly greater than the diameter of the pipe 61 of the nozzle unit 6.

The support 86 is provided with a member 8 for lightly engaging the pipe 61 fitted in the cutout 87.

The engaging member 8 comprises a tubular screw case 81 screwed in a side wall of the support 86 to extend to the cutout 87 and locked with a nut 85, an engaging piece 82 projectably fitting in the inner end of the case 81, a setscrew 84 screwed in the case outer end and a compression spring 83 provided between the setscrew 84 and the engaging piece 82.

The engaging piece 82 is retracted by being pressed by the pipe 61 when the pipe 61 is fitted into the U-shaped cutout 87. Upon the pipe 61 reaching the inner end of the cutout 87, the inner end of the engaging piece 82 projects from the case 81 into bearing contact with a side portion of the pipe 61 to hold the pipe 61 in position.

When the pipe 61 is pulled toward the opening of the cutout 87, the engaging piece 82 retracts into the case 81 against the spring 83, permitting the pipe 61 to be released from the support 86.

The support 86 is so attached to the container main body 21 that the opening of the cutout 87 is directed toward the closure 22, with the inner end of the cutout 87 located slightly closer to the closure 22 than the position immediately above the circular-arc edge defining the semicircular cutout 20a.

The U-shaped cutout 87 is positioned slightly closer to the closure 22 in order to support the pipe 61 vertically in view of the thickness of the seal member 66 to be described later and provided for the pipe 61.

A support member 91 is disposed on another side wall of the main body 21 of the pressure container 2 as shown in FIG. 1. The support member 91 is provided with a liftable nozzle support 72 having coupled thereto a lift unit 7 such as an air cylinder 71, solenoid or manual ring.

The nozzle support 72 has an L-shaped wall in a vertical plane, i.e., a horizontally elongated wall 72a and a vertically elongated wall 72b extending downward from one end of the wall 72a. A nozzle contact piece 73 and a nozzle support piece 74, both projecting laterally, are mounted on the wall 72a and the wall 72b, respectively.

The contact piece 73 has a positioning pin 73a projecting downward from the outer end thereof. A sleeve 74a vertically extends through the nozzle support piece 74.

Figure 6:
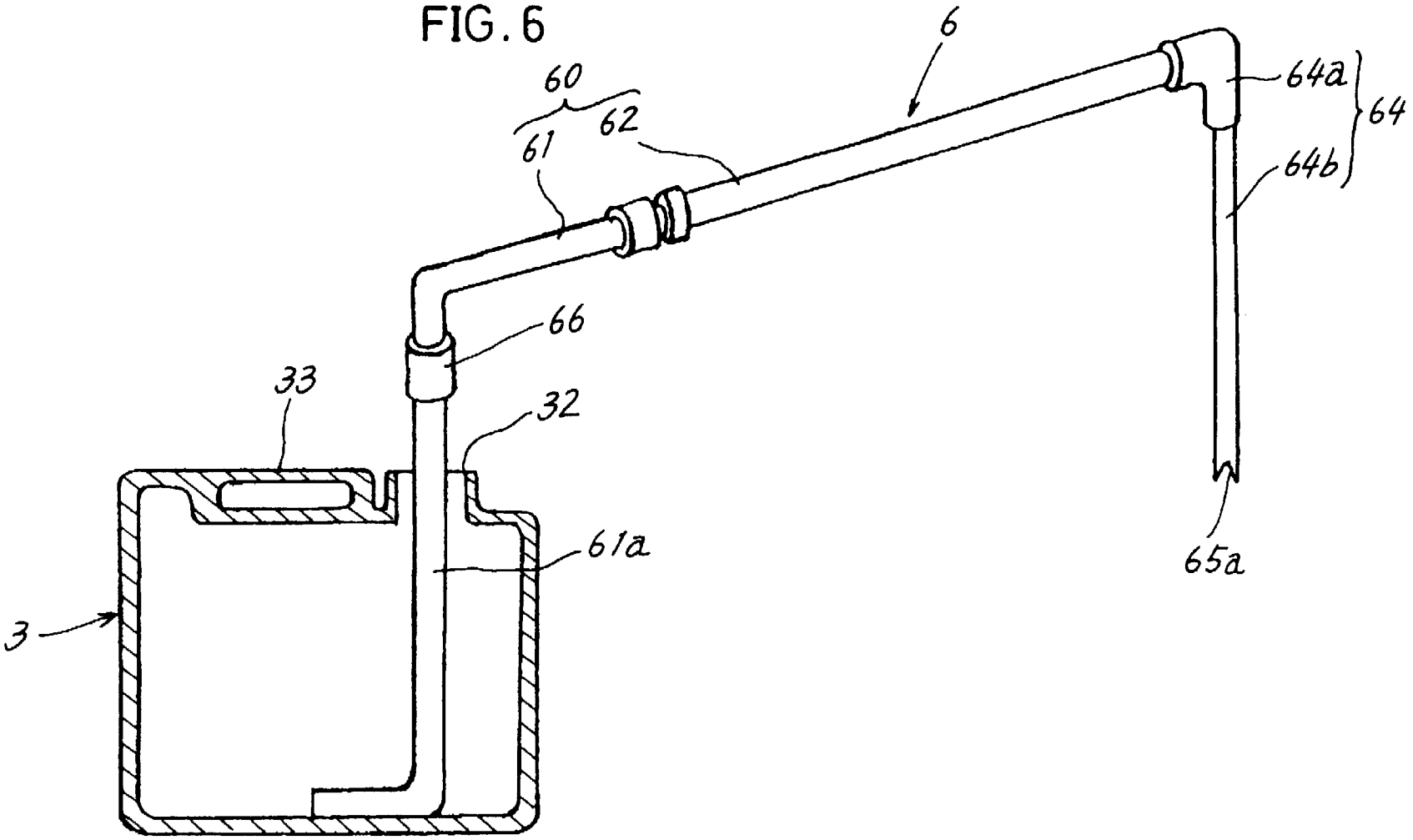
FIG. 6 is a view in section showing an ink tank with the nozzle unit inserted therein.

With reference to FIG. 6, a nozzle 64 comprises a synthetic resin pipe 64b and an L-shaped fitting 64a on the upper end of the pipe.

As shown in FIGS. 8A to 8D, the nozzle 64 has a lower end cut obliquely symmetrically to form inverted V-shaped openings 65a, 65a opposed each other diametrically of the nozzle. The wall portions 65b, 65b between the openings 65a, 65a are tapered to a point.

When the pipe 64b is 6.5 mm in inside diameter and 10 mm in outside diameter, the openings preferably have a height of about 20 mm.

Each wall portion 65b between the openings 65a, 65a is formed with a through hole 65c at a position about 10 mm above the tip of the wall portion.

Another embodiment of nozzle 64 may comprise a metal pipe, an L-shaped fitting 64a attached to the upper end of the pipe, and a short synthetic resin pipe fitted to the lower end of the pipe and having a lower end formed with openings 65a, 65a similar to those mentioned above.

A conduit 60 is joined to the L-shaped fitting 64a of the nozzle 64 to provide the nozzle unit 6. One end of the conduit 60 is inserted into the ink tank 3.

According to the embodiment, ink containing tanks commercially available from ink manufacturers are intended for use as the ink tank 3. The tank is provided at its top with an opening 32 toward one end and a handle 33 toward the other end as seen in FIGS. 2 and 6.

The conduit 60 of the embodiment comprises the pipe 61 which is made of brass and to be inserted into the ink tank 3, and a flexible hose 62 connected to the pipe 61. The pipe 61 has a vertical straight portion 61a with a lower end which is bent to an L-form and open toward a direction away from the opening 32 of the tank 3. The upper end of the pipe 61 is also bent to an L-form and connected to one end of the flexible hose 62, the other end of which is joined to the L-shaped fitting 64a of the nozzle 64.

The pipe 61 is loosely inserted through the opening 32 of the ink tank 3 to extend to the bottom of the tank.

The flexible hose 62 is made of a synthetic resin, flexible but hard, effectively restores itself elastically, and will not be bent to a V-form unless subjected to a considerably great force.

The straight portion 61a of the pipe 61 is provided with the aforementioned seal member 66 at the part thereof inserted through the bore 20 of the pressure container 2.

The container main body 21 is provided in its top wall with a connection port 28 having a pressuring unit 4 and a pressure reducing unit 5 connected thereto as shown in FIG. 2.

Figure 7:
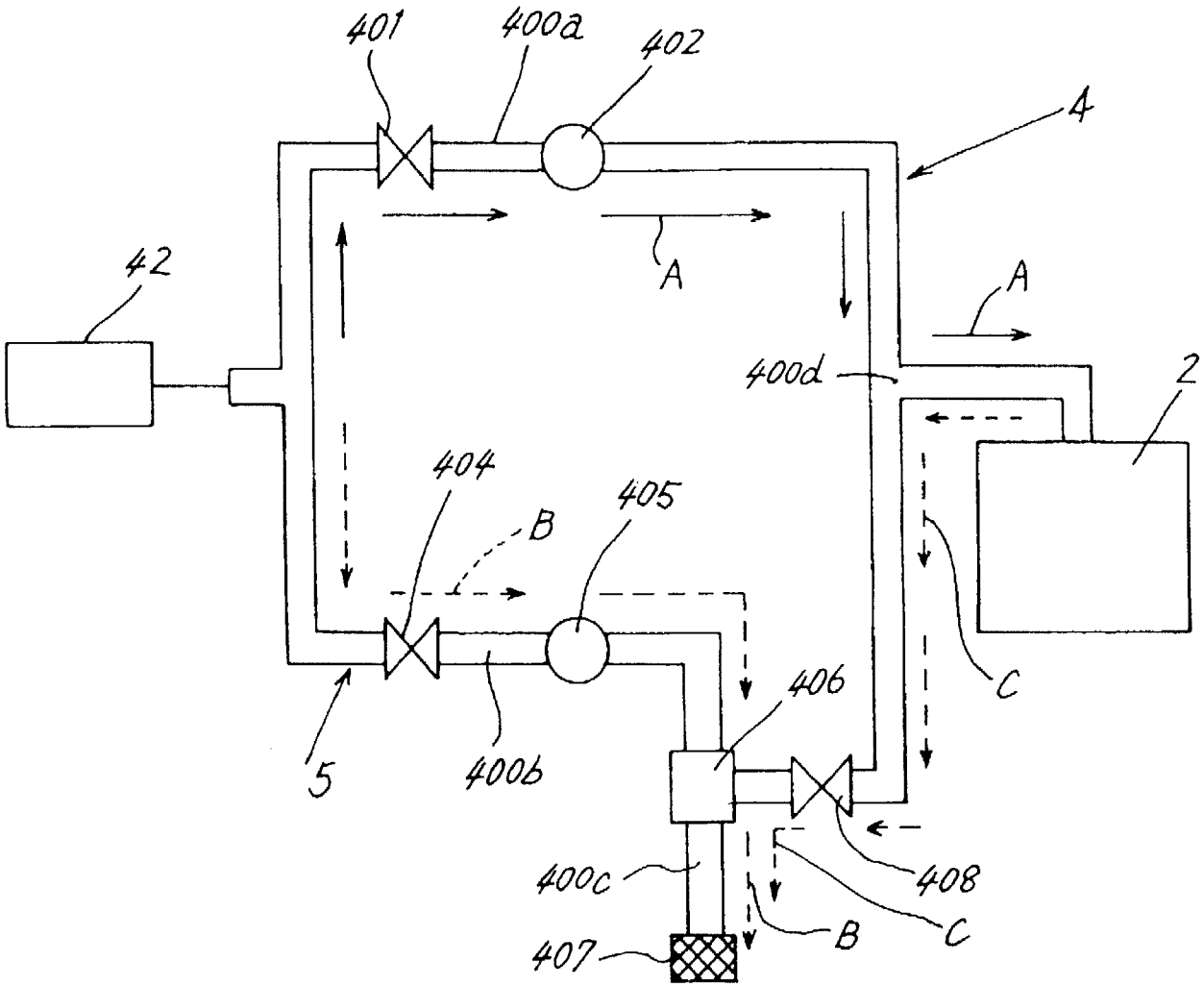
FIG. 7 is a diagram for illustrating a pressurizing unit and a pressure reducing unit.

With reference to FIG. 7, the pressuring unit 4 and the pressure reducing unit 5 of the embodiment are adapted to increase or reduce the internal pressure of the closed pressure container 2 by changing over the air channel of a single compressor 42.

The pressurizing unit 4 and the pressure reducing unit 5 are provided respectively by first and second channels 400*a*, 400*b* branching out from the compressor 42.

The first channel 400*a* has a branch line connected to the pressure container 2 and is joined to the second channel 400*b* by way of an ejector (vacuum generator) 406.

Via the second channel 400*b*, compressed air is sent into the ejector 406, causing suction to act in the first channel 400*a* to produce a vacuum as is known.

A third channel 400*c* extends from the ejector 406 as an extension of the second channel 400*b* and is left open to the atmosphere by way of a silencer 407.

Between the compressor 42 and the branch portion 400*d* connected to the pressure container 2, the first channel 400*a* has a directional control valve 401 and a pressure reducing valve 402 downstream from the valve 401. The channel 400*a* also has a directional control valve 408 adjacent to the ejector 406.

The second channel 400*b* has a directional control valve 404 at an upstream portion thereof and a pressure reducing valve 405 downstream from the valve 404.

When applying an increased pressure to the pressure container 2, the pressurizing unit 4 is operated by closing the downstream directional control valve 408 of the first channel 400*a* and the directional control valve 404 of the second channel 400*b* and opening the upstream directional control valve 401 of the first channel 400*a*.

High-pressure air flows from the compressor 42 into the pressure container 2 via the pressure reducing valve 402 as indicated by arrows A to increase the internal pressure of the container 2.

For a pressure reduction, the pressure reducing unit 5 is operated by closing the upstream control valve 401 of the first channel 400*a* and opening the downstream control valve 408 of the first channel 400*a* and the control valve 404 of the second channel 400*b*. High-pressure air flows from the compressor 42 into the third channel 400*c* via the second channel 400*b* as indicated by arrows B, passing through the ejector 406 at a high speed to produce a negative pressure and creating an air flow from the pressure container 2 into the third channel 400*c* as indicated by arrows C to give a negative internal pressure to the container 2.

For the supply of ink, a liquid level sensor is provided for an ink reservoir between the main roll 1 and the auxiliary roll 11 to monitor the liquid level of the ink. When the liquid level drops to a value not higher than a predetermined lower limit, the sensor automatically produces an ink supply signal to operate the pressurizing unit 4 by a change-over and supply the ink.

Upon the liquid level reaching a predetermined upper limit, the compressor 42 stops to discontinue the supply of ink.

The ink is collected automatically in response to a signal from a control unit (not shown), following manipulation of a manual button (not shown) or upon completion of production of a specified quantity of prints.

[Installation Procedure]

The closure 22 of the pressure container 2 is opened, and an ink tank 3 is placed into the main body 21.

The ink tank 3 has the nozzle unit 6 attached thereto in advance by inserting the pipe 61 through the opening 32 of the ink tank 3.

When the ink tank 3 is placed into the container main body 21, an upper portion of the pipe 61 is pushed into the innermost portion of U-shaped cutout 87 of the conduit support 86, with the seal member 66 fitted into the semicircular cutout 20*a* of the main body 21. The pipe 61 is automatically supported in a horizontal position by the support 86 as already described.

The closure 22 is closed and locked by the latch means 26.

The nozzle unit 6 is installed on the nozzle support 72.

As shown in FIGS. 1 and 2, this procedure is performed merely by inserting the nozzle 64 of the nozzle unit 6 through the sleeve 74*a* on the nozzle support 72 from above and moving the flexible hose 62 past the positioning pin 73*a* therebelow into contact with the lower face of the contact piece 73.

This procedure is much simpler and more efficient than the conventional procedure of setting the nozzle on the nozzle support 72 and placing the soft flexible tube around the rotor of the tube pump.

Since the flexible hose 62 is hard and has great ability to elastically restore itself, the hose 62 somewhat acts to push up the contact piece 73 from below, and the resulting reaction causes the L-shaped fitting 64*a* of the nozzle 64 to press the upper end of the sleeve 74*a* on the nozzle support piece 74. This prevents the nozzle 64 from moving upward, while the positioning pin 73*a* prevents the hose 62 from slipping off the contact piece 73 sideways.

When the nozzle support 72 descends in the state described, the lower end of the nozzle 64 reaches the bottom of the ink reservoir between the main roll 1 and the auxiliary roll 11, and the nozzle openings 65*a*, 65*a* are opposed to the respective rolls 1, 11 and partly closed.

[Ink Supplying Procedure]

When the ink is to be supplied, the system including the pressurizing unit 4 and the pressure reducing unit 5 is changed over to operate the unit 4 as previously stated with the level of the nozzle unaltered.

A flow of high-pressure air from the compressor 42 fills the interior of the pressure container 2 to a high pressure within a short period of time, causing the ink in the tank 3 to flow out from the nozzle 64.

At the same time, the container 2 and the nozzle 64 are moved in parallel to the axial direction of the rolls 1, 11 to supply the ink along the ink reservoir between the rolls.

The rate of flow of the ink from the nozzle 64 can be determined as desired by adjusting the pressure reducing valve 402.

[Ink Collecting Procedure]

When the ink is to be collected, the nozzle 64 is brought down close to or into contact with the bottom of the ink reservoir between the rolls 1, 11, and the system including the pressuring unit 4 and the pressure reducing unit 5 is changed over to operate the unit 5. The container 2 and the nozzle 64 are moved in parallel to the axial direction of the rolls.

The suction produced by a high-speed air flow through the ejector 406 gives a negative internal pressure to the container 2 within a short period of time, causing the nozzle 64 to withdraw the ink from the reservoir and collect the ink into the tank 3. A specified period of time later, the compressor 42 is brought out of operation, and the nozzle 64 is raised to the original position.

[Ink Replacing Procedure]

The ink is replaced by a procedure reverse to the above, i.e., by removing the nozzle unit 6 from the nozzle support 72 and removing the ink tank 3 from the pressure container 2 with the pipe 61 of the unit 6 fitted to the tank 3. A new ink tank 3 and another nozzle unit 6 are then installed in place.

Since the internal pressure of the pressure container 2 and the ink tank 3 is increased or reduced by a high-speed air flow for supplying or collecting the ink, the ink can be supplied or collected within a shorter period of time than when the conventional tube pump 101 is used, by reducing the ink supply or collection rise time and increasing the amount of transport of the ink per unit time. The use of only one compressor 42 results in a simplified construction and a reduced cost.

The flexible hose 62 used for the conduit 60 between the ink tank 3 and the nozzle 64 can be made of such a hard material that the hose will not be bent to a V-form by the upward and downward movement of the nozzle 64 unlike the tube which bends to a V-form to greatly impair the transport capacity of the tube pump.

The ink supplying or collecting capacity can be controlled as desired by adjusting the increased pressure or suction to be applied to the pressure container 2.

The wall portions 65*b*, 65*b* of the lower end of the nozzle 64 between the openings 65*a*, 65*a* which are approximately in an inverted V-form are tapered, so that the nozzle 64 can be lowered to a position where the openings 65*a*, 65*a* are partly closed with the peripheral surfaces of the rolls 1, 11, while air, even if flowing into the nozzle end, will be drawn up together with the ink at the same time almost without impairing the ink aspirating capacity. Consequently, the amount of ink remaining uncollected in the ink reservoir between the rolls 1, 11 can be much smaller than conventionally to shorten the time required for the subsequent cleaning step.

Even if the openings 65*a*, 65*a* of the nozzle 64 are closed with the roll surfaces, the ink is drawn up through the holes 65*c* of the nozzle for collection insofar as the liquid level of the ink reservoir is higher than the holes 65*c*, hence an improved ink collecting efficiency.

Further if the liquid level lowers below the through holes 65*c* of the nozzle 64, the holes 65*c* decrease the suction force and therefore serve to eliminate the likelihood that the suction force will collapse the nozzle end to a flat form if excessively great.

Since the tube pump is not used, the conduit 60 connecting the ink tank 3 to the nozzle 64 can be shortened. This decreases the amount of ink to be wasted as deposited inside the conduit 60 and assures more rapid cleaning of the conduit 60.

The lower end of the pipe 61 inserted in the ink tank 3 is bent in a direction away from the opening 32 of the tank 3 according to the embodiment. Even if air is incorporated into the ink to bubble up the ink within the tank 3 during collection, the position of bubbling is thus remote from the opening 32. This obviates the likelihood of the ink spilling from the opening.

When the channel 400*a* of the pressurizing unit 4 is merely closed between the compressor 42 and the container 2 upon the ink level reaching the upper limit during the supply of ink, a high pressure remains in the first channel 400*a*, inevitably permitting some ink to drip from the nozzle 64. However, the directional control valves 404, 408 are opened for about 2 sec. after the directional control valve 401 is closed by an ink supply stop signal, thereby reducing the internal pressure of the container 2 to prevent the ink from dripping.

EXAMPLE

Differences in the height of the openings 65*a*, 65*a* in the lower end of the nozzle 64, and the presence or absence of the through holes 65*c* in the wall portions between the openings 65*a*, 65*a* were checked for the resulting differences in the amount of ink remaining in the ink reservoir between the rolls 1, 11 after collecting the ink.

Conditions

Nozzle inside diameter: 6.5 mm.
Nozzle outside diameter: 10 mm.
Amount of ink remaining in the reservoir before collection: 900 c.c.
Ink collecting time: 1 min. 14 sec.

Each of the nozzles mentioned below was tested four times under the above conditions to determine the average amount of remaining ink. The results are as follows.

Figure 8A:
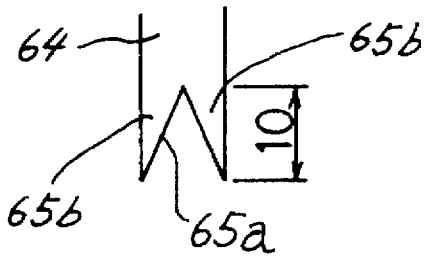
FIGS. 8A, 8B, 8C and 8D are enlarged front views showing nozzle ends.

About 146 c.c. in the case where the openings 65*a*, 65*a* were 10 mm in height in the absence of the holes 65*c* as shown in FIG. 8A.

Figure 8B:
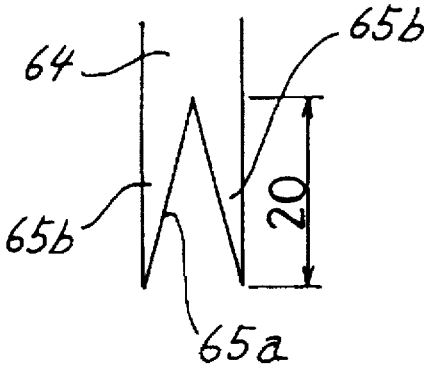

About 75 c.c. in the case where the openings 65*a*, 65*a* were 20 mm in height in the absence of the holes 65*c* as shown in FIG. 8B.

Figure 8C:
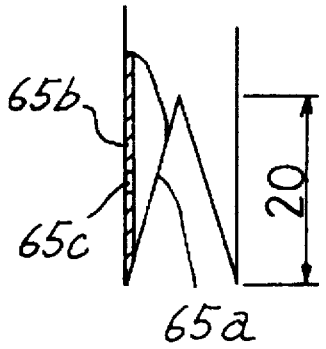
Figure 8D:
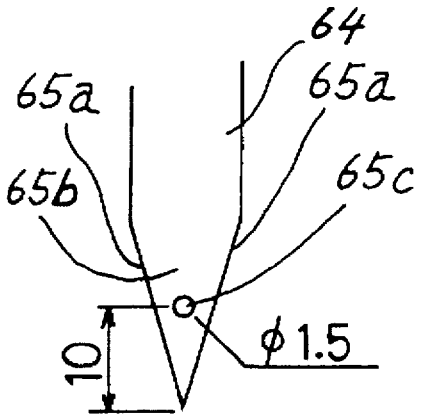
Figure 9:
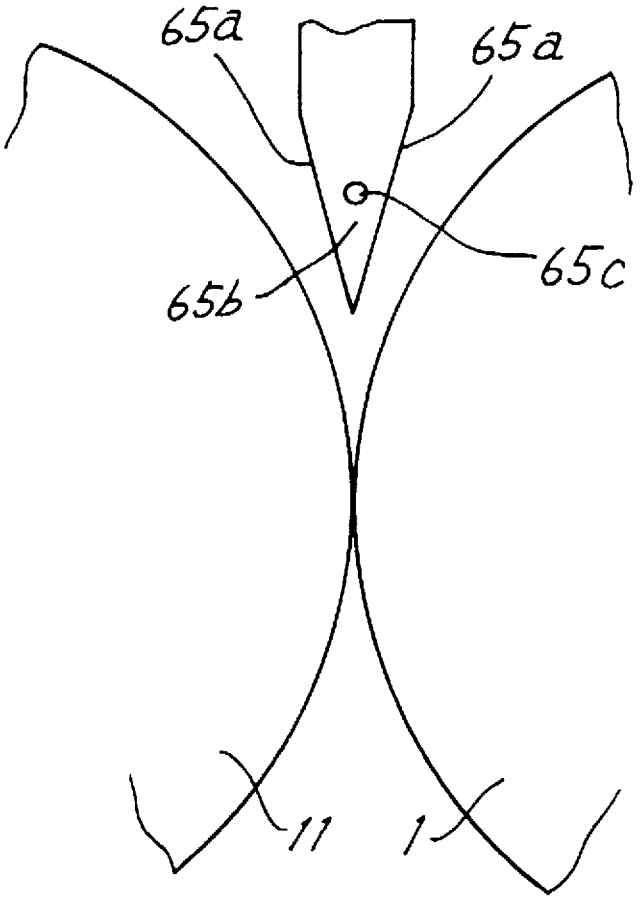
FIG. 9 is a front view showing the direction of nozzle openings relative to an ink reservoir.

About 66.5 c.c. in the case where the openings 65*a*, 65*a* were 20 mm in height in the presence of holes 65*c*, 1.5 mm in diameter, at a level of 10 mm from the tip as shown in FIGS. 8C and 8D.

With the conventional collecting device of the tube pump, the amount was 212 c.c. after the ink was collected for 1 min. 40 sec.

The time required for thoroughly cleaning the rolls after collecting the ink was 1 min. in the case of the invention, but the corresponding time required for the conventional device of the tube pump type was 2 min. 30 sec.

Further the invention required 15 sec. for replacing the ink, i.e., for removing the nozzle unit and the ink tank and installing another nozzle unit and a new ink tank, whereas the conventional device of the tube pump type required about 40 sec. for the replacement.

As will be apparent from the foregoing description, the ink supplying and collecting device of the invention is superior to the conventional ink supplying-collecting device of the tube pump type with respect to any of the ink collecting efficiency, ink collecting time, roll cleaning time and the time required for the replacement of ink.

What is claimed is:

1. An ink supplying and collecting device for a printing press wherein an ink reservoir is formed between a main roll for applying an ink to a plate cylinder and an auxiliary roll in contact with the main roll, the device being adapted to supply the ink to the ink reservoir by causing the ink to flow out from a nozzle extending downward as directed toward the ink reservoir while moving the nozzle in parallel to axial direction of the rolls, and to collect the ink by lowering the nozzle to a position close to a bottom of the ink reservoir and drawing up the ink with the nozzle while moving the nozzle in parallel to the axial direction of the rolls, the device comprising:

a closed pressure container disposed above the main and auxiliary rolls and movable by a drive unit in parallel to the axial direction of the rolls for removably accommodating an ink tank therein;

the ink tank replaceably accommodated in the pressure container;

a nozzle unit hermetically inserted in the pressure container and having one end loosely extending through an opening of the ink tank to a position close to a bottom of the ink tank and the other end providing the nozzle; and a pressurizing unit and a pressure reducing unit switchably connected to the pressure container.

2. An ink supplying and collecting device as defined in claim 1 wherein a common compressor is used for the pressuring unit and the pressure reducing unit, and a first channel and a second channel branch out from a pressure air outlet of the compressor, the first channel having a downstream portion divided into two lines, one of the lines being connected to the pressure container, the other line being joined to the second channel via an ejector, vacuum generator, and subsequently left open to the atmosphere, the ejector being adapted to withdraw air from the first channel and produce a vacuum by receiving compressed air from the second channel, the first channel being provided with a directional control valve between the compressor and the divided portion and a directional control valve on said other line connected to the ejector, the second channel having a directional control valve upstream from the ejector.

3. An ink supplying and collecting device as defined in claim 1 wherein the nozzle unit comprises the nozzle and a conduit having one end inserted in the ink tank and the other end connected to the nozzle, the nozzle being removably inserted through a nozzle support from above, the nozzle support being movable with the pressure container and having a contact piece for preventing the nozzle from rising, the nozzle being upwardly removable from the nozzle support with the nozzle unit disengaged from the contact piece when the ink is to be replaced.

4. An ink supplying and collecting device defined in claim 1 wherein the nozzle has a lower end formed with symmetric openings, each approximately inverted V-shaped and tapered wall portions between the openings and the inverted V-shaped openings of the nozzle are positionable as opposed to peripheral surfaces of the main roll and the auxiliary roll.

5. An ink supplying and collecting device as defined in claim 4 wherein a through hole is formed in each of the wall portions of the nozzle lower end between the inverted V-shaped openings.

6. An ink supplying and collecting device as defined in claim 1 wherein the pressure container comprises a container main body and a closure hermetically closing an open side of the main body, and a bore for inserting a conduit of the nozzle unit therethrough is formed in the main body and the closure and has a center at the boundary therebetween, a seal member being provided in the bore around the conduit.

* * * * *